US007201409B2

(12) United States Patent
Adachi et al.

(10) Patent No.: US 7,201,409 B2
(45) Date of Patent: Apr. 10, 2007

(54) RETRACTING LOCKING MECHANISM FOR OPERABLE UNIT IN STOP POSITION

(75) Inventors: Takefumi Adachi, Yokohama (JP); Ryuhei Nishida, Yokohama (JP)

(73) Assignee: Nifco Inc., Yokohama-Shi (JP)

( * ) Notice: Subject to any disclaimer, the term of this patent is extended or adjusted under 35 U.S.C. 154(b) by 97 days.

(21) Appl. No.: 11/176,234

(22) Filed: Jul. 8, 2005

(65) Prior Publication Data

US 2006/0012187 A1 Jan. 19, 2006

(30) Foreign Application Priority Data

Jul. 16, 2004 (JP) ..... 2004-210300

(51) Int. Cl.
*E05C 19/00* (2006.01)
*E05C 17/44* (2006.01)

(52) U.S. Cl. ..... 292/304; 292/101; 292/145; 292/175; 292/341.15; 292/DIG. 4; 292/DIG. 37

(58) Field of Classification Search ..... 292/304, 292/95, 101, 137, 145, 175, 341.15, DIG. 4, 292/DIG. 37
See application file for complete search history.

(56) References Cited

U.S. PATENT DOCUMENTS 1,199,849 A * 10/1916 Willoughby ..... 105/434
4,227,726 A * 10/1980 Sorimachi ..... 292/251.5
5,090,751 A * 2/1992 Kobayashi ..... 292/71
5,401,067 A * 3/1995 Kurosaki et al. ..... 292/63
5,762,385 A * 6/1998 Mader et al. ..... 292/219
5,775,748 A * 7/1998 Kurachi ..... 292/341.15
5,997,056 A * 12/1999 Yamagishi ..... 292/341.17
6,276,737 B1 * 8/2001 Cansfield et al. ..... 296/37.8
6,869,114 B2 * 3/2005 Ueki ..... 292/341.17
7,002,092 B2 * 2/2006 Ichimaru ..... 200/523
2005/0067840 A1 * 3/2005 Koveal et al. ..... 292/95
2006/0255599 A1 * 11/2006 Su et al. ..... 292/304

FOREIGN PATENT DOCUMENTS

JP 03228985 * 3/1991
JP 06212850 * 6/1994
JP 6212850 8/1994
JP 08-021147 1/1996
JP 11166344 6/1999

* cited by examiner

*Primary Examiner*—Brian E. Glessner
*Assistant Examiner*—Carlos Lugo
(74) *Attorney, Agent, or Firm*—Manabu Kanesaka

(57) ABSTRACT

A retracting locking mechanism for an openable unit includes a striker attached to one of the openable unit and a fixed unit, and a catcher attached to the other of the openable unit and the fixed unit. The catcher includes an inner part, and an outer part for housing the inner part. A coil spring is disposed between the inner and outer parts for biasing the inner part in a retreating direction to pull into the outer part. A dampening device provides dampening force to the retreating movement of the inner part caused by the coil spring.

8 Claims, 12 Drawing Sheets

RETRACTING LOCKING MECHANISM FOR OPERABLE UNIT IN STOP POSITION

BACKGROUND OF THE INVENTION AND RELATED ART STATEMENT

The present invention relates to a locking mechanism to stably maintain the halted state of an openable unit, such as a hinged door, sliding door, and drawer, at the stop position, including the fully closed position.

Patent Reference 1 discloses a shock absorber for a sliding door to ease the shock felt by the door when it is closed by allowing the uneven section provided in the slider to fit into the uneven section provided in the receiving member when the sliding door moves toward the stop position.

Such a shock absorber, however, was unable to completely absorb the shock when the traveling speed of the sliding door moving in the closing direction was excessive. Moreover, when the traveling speed was small, the sliding door came to a halt before it was completely closed.

Patent Reference 1: Japanese Unexamined Patent Publication No. H08-21147.

In view of the above problems, an object of the present invention is to provide an a retracting locking mechanism for an openable unit for producing and stably maintaining the halted state of the openable unit regardless of the traveling speed of the openable unit moving towards the stop position, while allowing it to gently come to a halt.

Further objects and advantages of the invention will be apparent from the following description of the invention.

SUMMARY OF THE INVENTION

In order to solve the problems described above, the retracting locking mechanism for an openable unit at a stop position according to the present invention comprises the following features (1)–(7):

(1) a locking mechanism has a striker disposed in either an openable unit at or around an abutting section that adjoins an abutted section of a fixed unit in the stop position or the fixed unit at or around the abutted section, and a catcher disposed in the other of the two, (2) the striker has a hook-shaped section comprising a neck extending along the traveling direction of the openable unit and a head projecting from the neck in the direction perpendicular to the traveling direction, (3) the catcher has an inner part, an outer part for housing the inner part, a coil spring for always biasing the inner part in the retreating direction to pull it into the outer part, and dampening means for providing dampening force to the retreating movement of the inner part caused by the coil spring, (4) the inner part has a rotating part comprising a hook-shaped section with a neck and a head at the front end section, a locking projection on one side at the back end section, a shaft in the middle, and an abutting section projecting beyond the head of the hook-shaped section between the hook-shaped section and the shaft, and a slider comprising through holes for the shaft of the rotating part, the slider being combined with the rotating part via the shaft, the front end of the coil spring whose back end is anchored to the outer part being anchored thereto, (5) the outer part has a lock groove comprising a straight groove along the traveling direction of the inner part and a front groove connected to the front end of the straight groove and extending in the direction perpendicular to the traveling direction while creating a corner at the connected section, and a guide groove for housing one end of the shaft, formed on one side of the lock groove and extending along the traveling direction of the inner part, (6) the locking mechanism is so configured to allow the front groove of the lock groove to catch the locking projection utilizing the bias of the coil spring when the inner part is in the advanced position, while positioning the rotating part in the tilted position to prevent the hook-shaped section of the rotating part from entering the penetration space into which the striker will enter as the openable unit is moved towards the stop position, (7) the openable unit is moved towards the stop position allowing the head of the striker to abut against the abutting section of the rotating part that is in the tilted position, and this abutting action causing the rotating part to rotate about the shaft in the direction to allow the hook-shaped section to enter the penetration space while slightly advancing the inner part against the bias of the coil spring and allow the locking projection, which has been located in the front groove of the lock groove, to enter the straight groove According to the above construction, when the head of the striker abuts against the abutting section of the rotating part in the tilted position with the movement of the openable unit towards the stop position from the state in which the inner part is in the advanced position, force applies to the rotating part in the direction to move the shaft forward. Since the rotating part and the slider are combined via the shaft, the function of this force causes the inner part to slightly advance while expanding the coil spring. Since this forward movement releases the pressure contact between the locking projections and the lock grooves, the rotating part is turned about the shaft to insert the head of its hook-shaped section into the penetration space and pull the locking projections out of the front grooves of the lock grooves. (Hereinafter, this state is referred to as the engaging position of the rotating part.) With this, the hook-shaped section of the striker engages the hook-shaped section of the rotating part in the penetration space.

Once the locking projections are pulled out of the front grooves of the lock grooves, they are guided along the straight grooves of the lock grooves using the bias of the coil spring to thereby retreat the inner part. Since the pitch distance between the locking projections and the shaft remains unchanged, the rotating part is maintained in the engaging position once the locking projections enter the straight grooves, and the striker is pulled into the catcher, or the outer part, without releasing the engagement between the hook-shaped section of the rotating part and the hook-shaped section of the striker. With this, the state in which the abutting section of the openable unit abuts against the abutted section of the fixed unit is forcibly created, and stably maintained. Even in the case in which the traveling speed of the openable unit directed towards the stop position is relatively low, the aforementioned engagement between the striker and the inner part ensures the full movement of the openable unit to the stop position where the aforementioned abutting section and the abutted section abut against one another.

Alternatively, the locking mechanism may be so constructed to apply force to the rotating part in the direction to press the locking projection against the groove wall of the straight groove of the lock groove on the front groove side when the inner part is moved towards the advanced position by moving the openable unit in the stop position towards the initial position upon having the hook-shaped section of the rotating part of the inner part in the retreated position catch the hook-shaped section of the striker.

When so configure, moving the openable unit that is in the stop position towards the opening direction causes the locking projections of the rotating part to reenter the front grooves when the inner part is pulled to the position where the straight grooves and the front grooves of the lock grooves of the outer part are connected by the aforementioned force applied to the rotating part, thereby allowing the inner part to return to the advanced position, and stably maintaining this state. At the same time that the locking projections reenter the front grooves, the rotating part is turned about the shaft to the tilted position again using the bias of the coil spring, thereby disengaging the hook-shaped section of the rotating part from the hook-shaped section of the striker. This disengages the inner part from the striker, and allows the striker to pull out of the catcher; the state in which the openable unit is maintained in the stop position, so that it can be smoothly terminated with one action.

Alternatively, the aforementioned through holes of the slider may be shaped as slots and tilted to allow the rotating part to rotate about the locking projections while slightly advancing the inner part against the bias of the coil spring by utilizing the abutment of the hook-shaped section of the striker against the hook-shaped section of the rotating part within the catcher that is achieved by moving the openable unit towards the stop position in the event that the inner part is moved to the retreated position by an erroneous operation.

When the openable unit is moved towards the stop position from the state in which the inner part is erroneously retreated, force is applied to the rotating part by the abutment of the hook-shaped section of the striker against the hook-shaped section of the rotating part occurring in the catcher to turn the rotating part about the locking projections towards the tilted position. Here, since the through holes for the shaft are shaped as the aforementioned slots, the force moves the shaft that has been located at the front ends of the through holes towards the back ends of the through holes, turns the rotating part to the tilted position; the movement of the shaft slightly advances the inner part while expanding the coil spring. When the head of the hook-shaped section of the striker penetrates in front of the head of the hook-shaped section of the rotating part, which has been turned to the tilted position, the inner part is moved backward by the resilient recovery of the helical tension spring, the shaft is moved back to the front ends of the through holes of the slider, and the rotating part is returned to the engaging position. This produces the same condition as in the case in which the striker is received by the catcher in a normal operation.

Alternatively, the aforementioned dampening means may comprise a cylinder disposed in either the inner part's slider or the outer part, a head including an orifice that divides the space within the cylinder into two sections, and a shaft supported by the other of the inner part's slider or the outer part for supporting the head inserted into the cylinder, the dampening means generating dampening force by utilizing the flow resistance of the fluid that passes through the orifice with the retreating movement of the inner part.

When so constructed, the bias of the coil spring moves the inner part from the advanced position with accompanying rearward movement of the cylinder while allowing the fluid to pass through the orifice created in the head. With this, the movement of the inner part is appropriately dampened.

Alternatively, the aforementioned fluid channel to the orifice may be constructed so as to become narrower as the speed at which the inner part is pressed in increases.

When so constructed, the greater the traveling speed, or relative traveling speed, of the head, i.e., the greater the retreating speed of the inner part constituting the locking mechanism or the traveling speed of the openable unit towards the stop position becomes, the greater the dampening force applied to the retreating movement. Regardless of the traveling speed of the openable unit towards the stop position, the aforementioned abutting section and the abutted section abut against one another in such a manner that the generation of impulsive sound is prevented.

Alternatively, the guide groove and lock groove may be disposed on both sides, interposing the longitudinal axis, of the aforementioned outer part.

This configuration provides regularity in the movement of the inner part on both sides that interposes the longitudinal axis of the outer part, and allows the inner part to move smoothly.

According to the locking mechanism of the present invention, the halted state of the openable unit can be appropriately achieved regardless of the traveling speed of the openable unit moving in the closing direction, and that state also can be stably maintained. In addition, the halting action can be performed gently.

DETAILED DESCRIPTION OF PREFERRED EMBODIMENTS

In the following, the best mode of the invention will be explained based on FIGS. 1–13.

Figure 1:
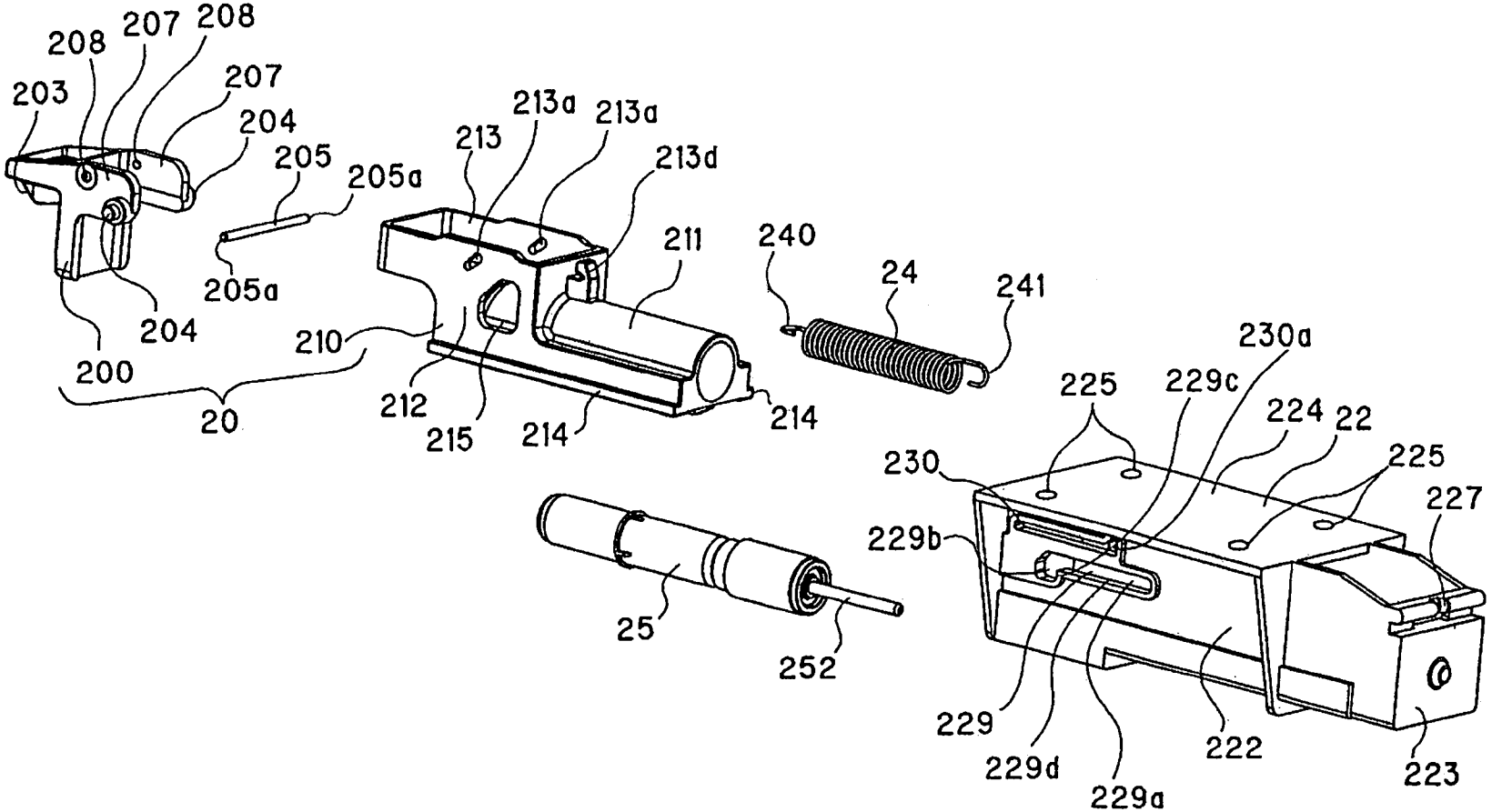
FIG. 1 is an exploded perspective view of a catcher.
Figure 2:
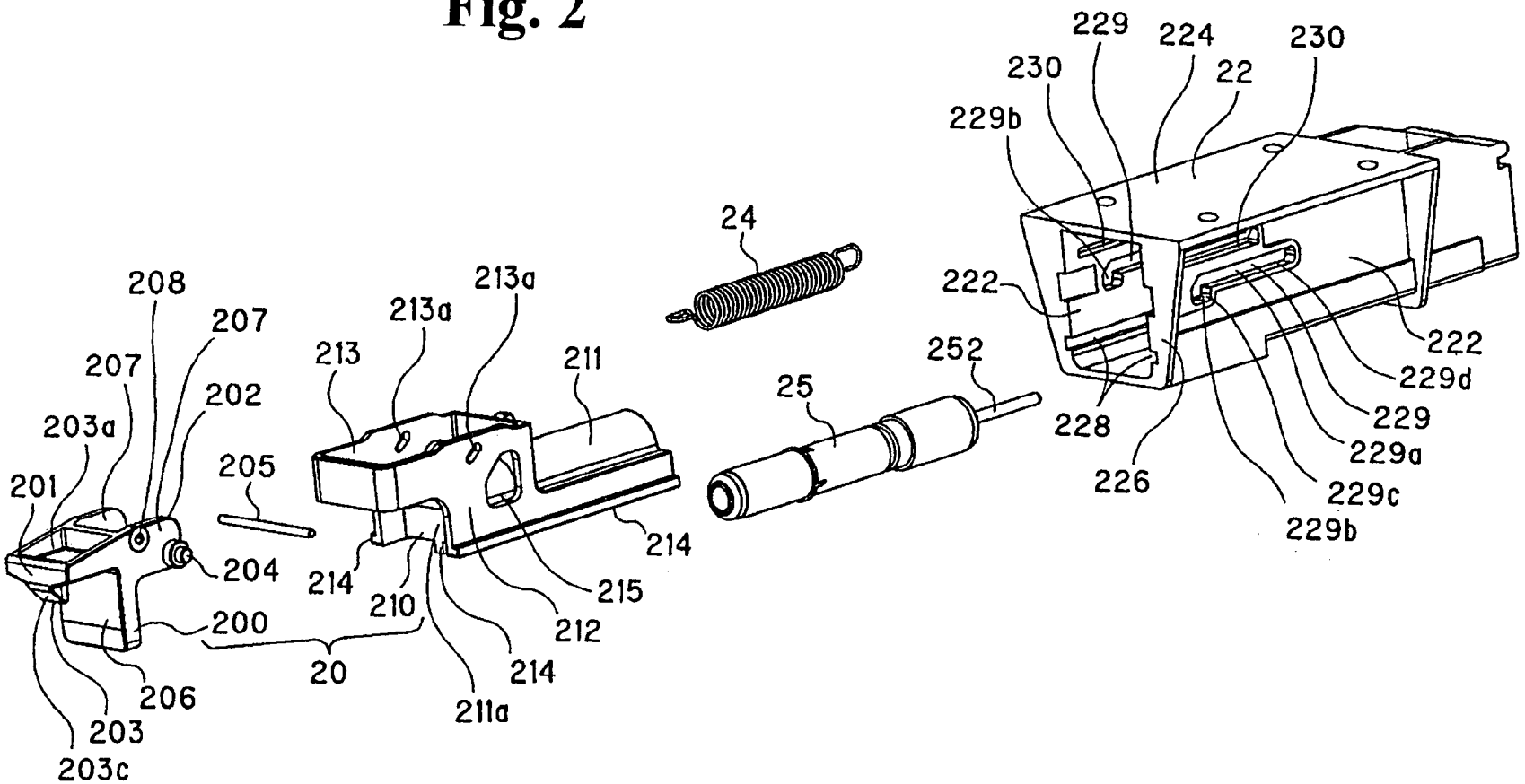
FIG. 2 is another exploded perspective view of the catcher.
Figure 3:
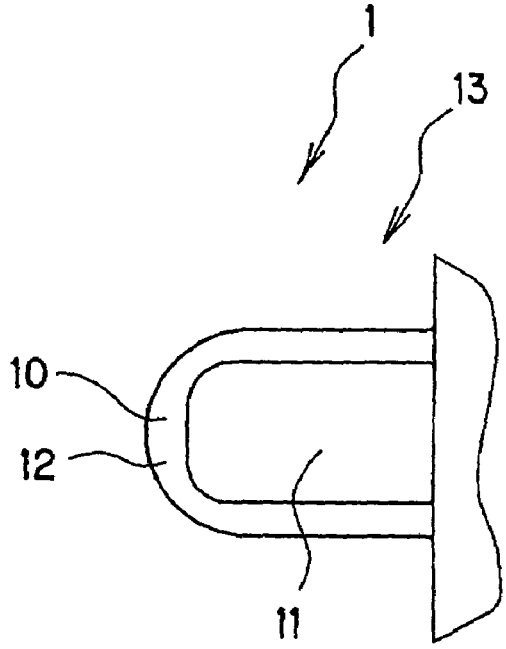
FIG. 3 is a plan view of a striker.
Figure 4:
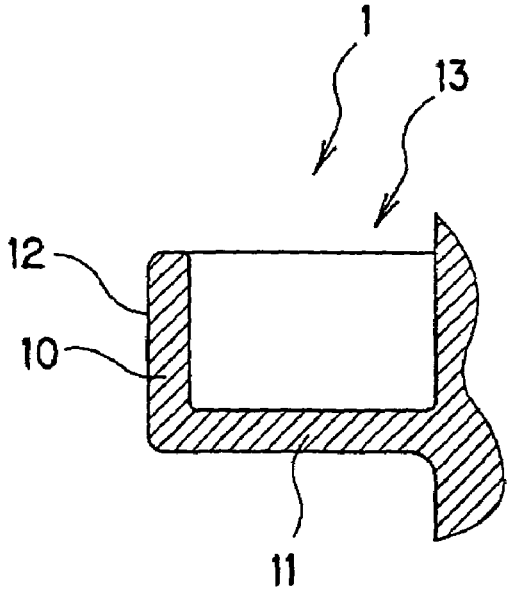
FIG. 4 is a sectional view of the same.
Figure 5:
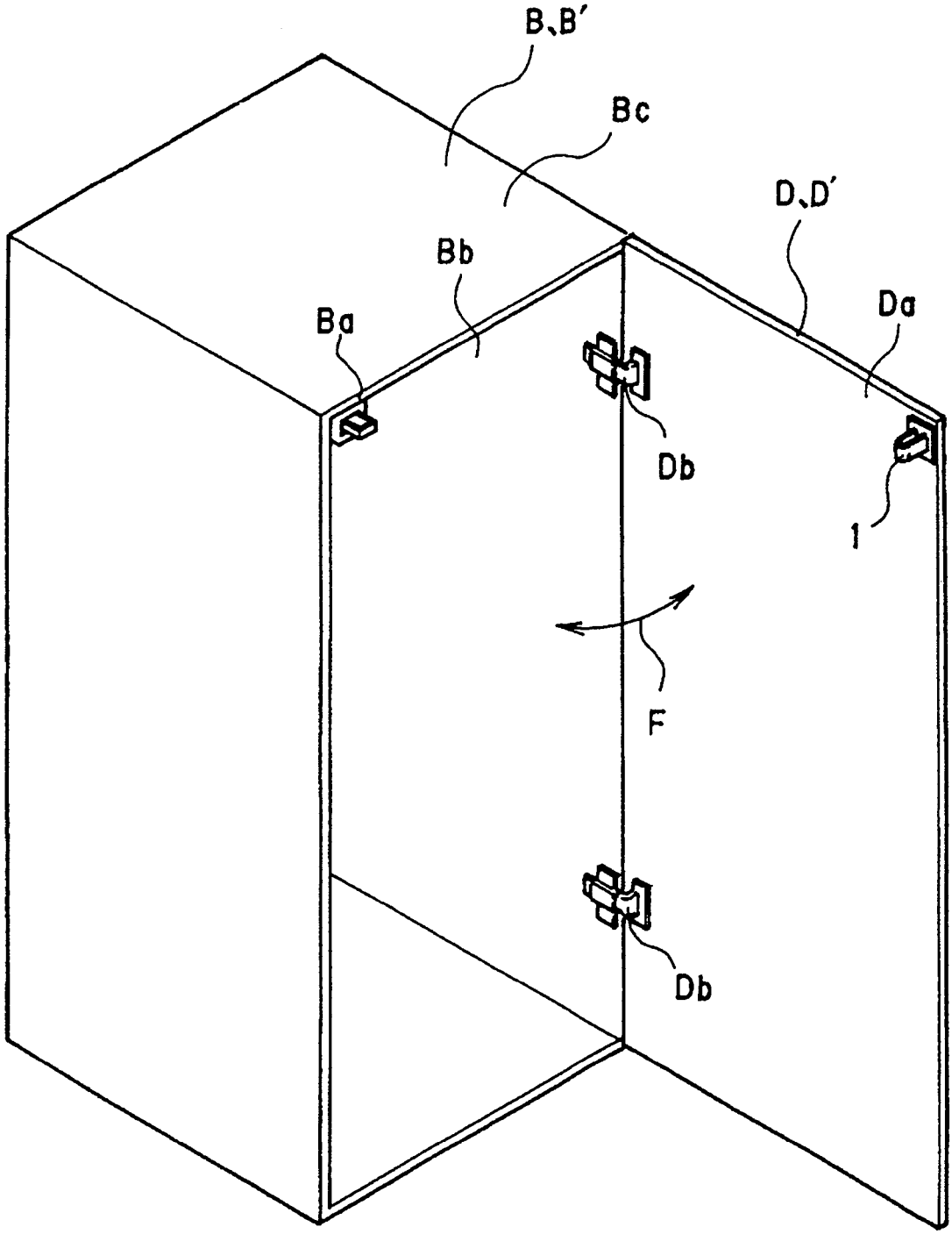
FIG. 5 is a perspective view of a locking mechanism in use.

FIGS. 1 and 2 show a catcher 2 constituting the locking mechanism with the individual components shown separately. (FIG. 2 is the view of the components shown in FIG. 1 with the right sides facing forward.) FIGS. 3 and 4 show a striker 1. FIG. 5 shows an example of the locking mechanism that is applied to a hinged door D'.

FIGS. 6–13 show the locking mechanism in each stage of the operation for better understanding of the operation. When the openable unit D is moved towards the stop position (going to one way), the striker 1 engages with the catcher 2 in the order shown in FIGS. 6, 7, and 8, and the openable unit D achieves the stop position (the position shown in FIG. 8) with this engagement. When the openable unit D in the stop position is moved towards the initial position (going to the other way), the aforementioned engagement between the striker 1 and the catcher 2 is terminated in the order shown in FIGS. 8, 9, and 10. If the inner part 20 of the catcher 2 is retreated by an erroneous operation when the striker 1 is not fitted into the catcher 2, and the openable unit D is moved towards the stop position to fit the striker 1 into the catcher 2, the striker 1 engages the catcher 2 in the order shown in FIGS. 11, 12, and 13, and the openable unit D achieves the stop position with this engagement.

The locking mechanism in this embodiment locks an openable unit D, such as a hinged door, sliding door, and drawer, at the stop position so as to stably maintain the halted state.

When used in a hinged or sliding door, for example, the state in which an opening is covered by the hinged or sliding door is maintained by the locking mechanism.

When used in a drawer, the state in which the drawer is housed and the opening of the drawer space is covered by the front face of the drawer is maintained by the locking mechanism. The locking mechanism has a striker 1 and a catcher 2.

The striker 1 is provided in either the openable unit D at or around the abutting section Da, which abuts against the abutted section Ba of a fixed unit B in the stop position, or the fixed unit B at or around the abutted section Ba, while the catcher 2 is provided in the other of the two.

When the locking mechanism is used in a hinged door D' that openably covers the opening Bb of a storage unit B' using hinges Db having vertical axes, for example, either the striker 1 or the catcher 2 is disposed in the upper section of the back face of the door D' on the opposite side of the hinges Db, and the other of the two is disposed on the inner surface of the upper wall of the opening Bb of the storage unit B' where the upper section of the back face of the door D' on the opposite side of the hinges Db will be positioned in the stop position or the closed position. (FIG. 5)

(Striker 1)

The striker 1 has a hook-shaped section 10 comprising a neck 11 extending along the traveling direction f of the openable unit D and a head 12 projecting from the neck 11 in the direction intersecting the traveling direction.

In the example shown in the figures, the striker 1 is structured as a box-shaped projection 13, with an open top, that projects from the upper section of the back surface of the door D' on the opposite side of the hinges Db in the direction substantially perpendicular to the back surface. The bottom plate of the projection 13 forms the aforementioned neck 11, and the front plate functions as the head 12.

(Catcher 2)

The catcher 2 has an inner part 20, an outer part 22 to house the inner part 20 so as to move back and forth, a coil spring (a helical tension spring 24 in the example shown in the figures) to always bias the inner part 20 in the retreating direction to pull it inside of the outer part 22 (towards the left in the figures), and dampening means 25 to dampen the movement of the inner part 20 in the retreating direction caused by the helical torsion coil 24.

In the example shown in the figures, the inner part 20, the helical tension spring 24, and the dampening means 25 are housed in the outer part 22, which is an angular tube with the front end 226 open and the back end closed. In the example shown in the figures, moreover, the outer part 22 is attached to the storage unit B', so that the open front end 226 of the outer part 22 is positioned at the location where the upper section of the back surface of the openable unit D' on the opposite side of the hinges Db would be positioned when the openable unit D' is in the closed position, or the stop position.

More specifically, the outer part 22 has a bottom plate 221, a pair of side plates 222, a back plate 223, and an upper plate 224. Both lengthwise sides of the upper plate 224 overhang past the outer surfaces of the side plates 222, and holes 225 for screws or the like are created in the overhangs. In the example shown in the figures, moreover, the outer part 22, namely, the catcher 2, is installed to the storage unit B' by driving screws or the like into the top plate Bc of the storage unit B' through the holes 225 while placing the upper plate 224 of the outer part 22 against the back surface of the top plate Bc so that the front end 226 of the outer part 22 is facing the opening Bb of the storage unit B'.

(Catcher 2/Inner Part 20)

The inner part 20 is composed of a rotating part 200 and a slider 210.

The rotating part 200 has a hook-shaped section 203, composed of a neck 203*a* and a head 203*b*, in the front end section 201, a locking projection 204 on one side of the back end section 202, a shaft 205 in the mid section, and an abutting section 206, which projects more than the head 203*b* of the hook-shaped section 203 between the hook-shaped section 203 and the shaft 205.

The slider 210 has through holes 213*a* for the shaft 205 of the rotating part 200, and is combined with the rotating part 200 by allowing the shaft 205 to pass through the through holes 213*a*. In addition, the front end 240 of the helical tension spring 24, whose back end 241 is anchored to the outer part 22, is anchored to the slider 210.

(Catcher 2/Inner Part 20/Rotating Part 200)

In the example shown in the figures, the rotating part 200 forms a hook-shaped section 203 with a head 203*b* projecting downwardly, in the direction substantially perpendicular to the neck 203*a*, from the front end of the neck 203*a*. The front face of the head 203*b* is a slanted surface 203*c* that gradually tilts back as it approaches the peak of the head 203*b*. On both sides of the rear end section of the neck 203*a*, extending portions 207 that project rearwardly from the rear end of the neck 203*a* are formed. An abutting section 206, which is a plate whose upper end is integrally connected to the area where the neck 203*a* is connected to the extending portions 207, extends downwardly from the connected section. In the example shown in the figures, the abutting section 206 projects at a 90-degree angle to the direction in which the neck 203*a* extends. The lower end of the abutting section 206 is positioned at a level below the peak of the head 203*b*.

In the example shown in the figures, moreover, a locking projection 204 is disposed on the outer surface at the rear end section of each of the pair of extending portions 207. The pair of locking projections 204 is cylindrical in shape. The axes of the pair of locking projections are positioned along the imaginary line running crosswise across the inner part 20.

In the example shown in the figures, moreover, through holes 208 for the shaft 205 are created in the pair of extending portions 207 at locations near the base, at a level higher than the level of the locking projections 204 and behind the abutting section 206. In the example shown in the figures, the shaft 205 is fed through the pair of through holes 208 so that the axial line extends along the crosswise direction of the inner part 20, and the shaft 205 extends through the through holes 213*a* of the slider 210 and projects its ends 205*a*, which are fitted into the later described guide grooves 230 of the outer part 22.

(Catcher 2/Inner Part 20/Slider 210)

In the example shown in the figures, the slider 210 is composed of a tubular part 211 with a closed front end 211*a* and an open rear end, a pair of side plates 212 that rises up and has the front end 211*a* of the tubular part 211 therebetween, and a frame 213, which is supported by the side plates 212 on the side of the front end 211*a* of the tubular part 211 and has substantially rectangular inner and outer contours elongated front to back to have its front frame section overhang the front end 211*a* of the tubular part 211.

The aforementioned through holes 213*a* for the shaft 205 are formed in both sides of the frame 213, substantially in the middle of the frame 213 along the length thereof. The rotating part 200 is housed within the frame 213 in an orientation to have the head 203*b* and the extending side of the abutting section 206 face down, and with the shaft 205 fed through the through holes 213*a* so as to turn about the shaft 205. When the rotating part 200 is in the later described tilted position, the head 203*b* of the hook-shaped section 203 of the rotating part 200 is not allowed to project below the frame 213, and a gap x for operation is created between the front end 211*a* of the tubular part 211 and the back face of the abutting section 206. When the openable unit D is moved towards the stop position from the state in which the inner part 20 is in the advanced position, the striker 1 enters the space below the frame 213 of the slider 210, the outer face of the head 12 of the hook-shaped section 10 of the striker 1 abuts against the front face of the abutting section 206, the rotating part 200 turns so as to project the head 203*b* of the hook-shaped section 203 out of the frame 213, and the hook-shaped section 203 of the rotating part 200 engages the hook-shaped section 10 of the striker 1. That is, in the example shown in the figures, the lower section of the frame 213 of the slider 210 becomes the penetration space y for the striker 1.

In the example shown in the figures, moreover, an anchor 213*d* for the front end 240 of the helical tension spring 24 is formed in the back section of the frame 213 of the slider 210, while an anchor 227 for the rear end 241 of the helical tension spring 24 is formed in the upper section of the back plate 223 of the outer part 22.

In the example shown in the figures, a rib 214 extending from front to back is formed at the bottom of the slider 210 on each side of the bottom. The slider 210, or the inner part 20, is assembled into the outer part 22 so as to move back and forth by fitting each of the ribs 214 into the guide groove 228 formed at the inner corner where the bottom 221 of the outer part 22 comes into contact with each side plate 222.

In the example shown in the figures, moreover, the extending portions 207 of the rotating part 200 enter between the respective inner surfaces of the pair of side plates 212 of the slider 210 and the outer surface of the upper section of the tubular part 211; the locking projections 204 of the rotating part 200 project out from the side plates 212 through dummy holes 215 formed in the side plates 212.

(Catcher 2/Outer Part 22)

The outer part 22 is provided with a lock groove 229 for housing the locking projection 204, which is composed of a straight groove 229*a* formed along the traveling direction of the inner part 20 and a front groove 229*b* connected at the front end of the straight groove 229*a*, creating a corner at the connected section and extending perpendicularly to the traveling direction, and a guide groove 230 on one side of the lock groove, extending along the traveling direction of the inner part 20, for housing one end of the shaft 205.

In the example shown in the figures, the guide groove 230 and the lock groove 229 are formed in and penetrate through each of the pair of side plates 222 of the outer part 22. This provides regularity in the movement of the inner part 20 on both sides that interposes the longitudinal axis of the outer part 22, and allows the inner part 20 to move smoothly. In the example shown in the figures, moreover, the guide grooves 230 are located above the lock grooves 229. In addition, the guide groove 230 and the lock groove 229 on the right side plate 222 of the outer part 22 and the guide groove 230 and the lock groove 229 on the left side plate 222 of the outer part 22 are formed in symmetrical positions and shapes across the imaginary vertical plane that includes the longitudinal axis of the outer part 22.

The groove width of the guide groove 230 is substantially equal to or slightly wider than the size of the shaft 205. Each guide groove 230 begins in the position near the front end 226 of the outer part 22.

The groove width of the lock groove 229 is substantially equal to or slightly wider than the size of the locking projection 204. The front end of each lock groove 229 is more offset from the front end of the guide groove 230, and the back end of the lock groove 229 is more offset from the back end of the guide groove 230.

The total length of the outer part 22 is longer than the total length of the slider 210 of the inner part 20. When the inner part 20 is in the advanced position, a gap is created between the back end of the tubular part 211 of the slider 210 and the back plate 223 of the outer part 22. The inner part 20 is allowed to retreat up to the position where the back end of the cylinder 250, which constitutes the dampening means 25 inserted into the tubular part 211 of the slider 210 in the manner described later, abuts against the inner surface of the back plate 223 of the outer part 22.

In the example shown in the figures, moreover, the aforementioned straight grooves 229*a* of the lock grooves 229 are formed so as to extend along the longitudinal axis of the outer part 22. The front grooves 229*b* extend in the direction substantially perpendicular to the longitudinal axis of the outer part 22. The forward facing catching surfaces 229*c* for the locking projections 204 are formed with these front grooves 229*b*.

Figure 6:
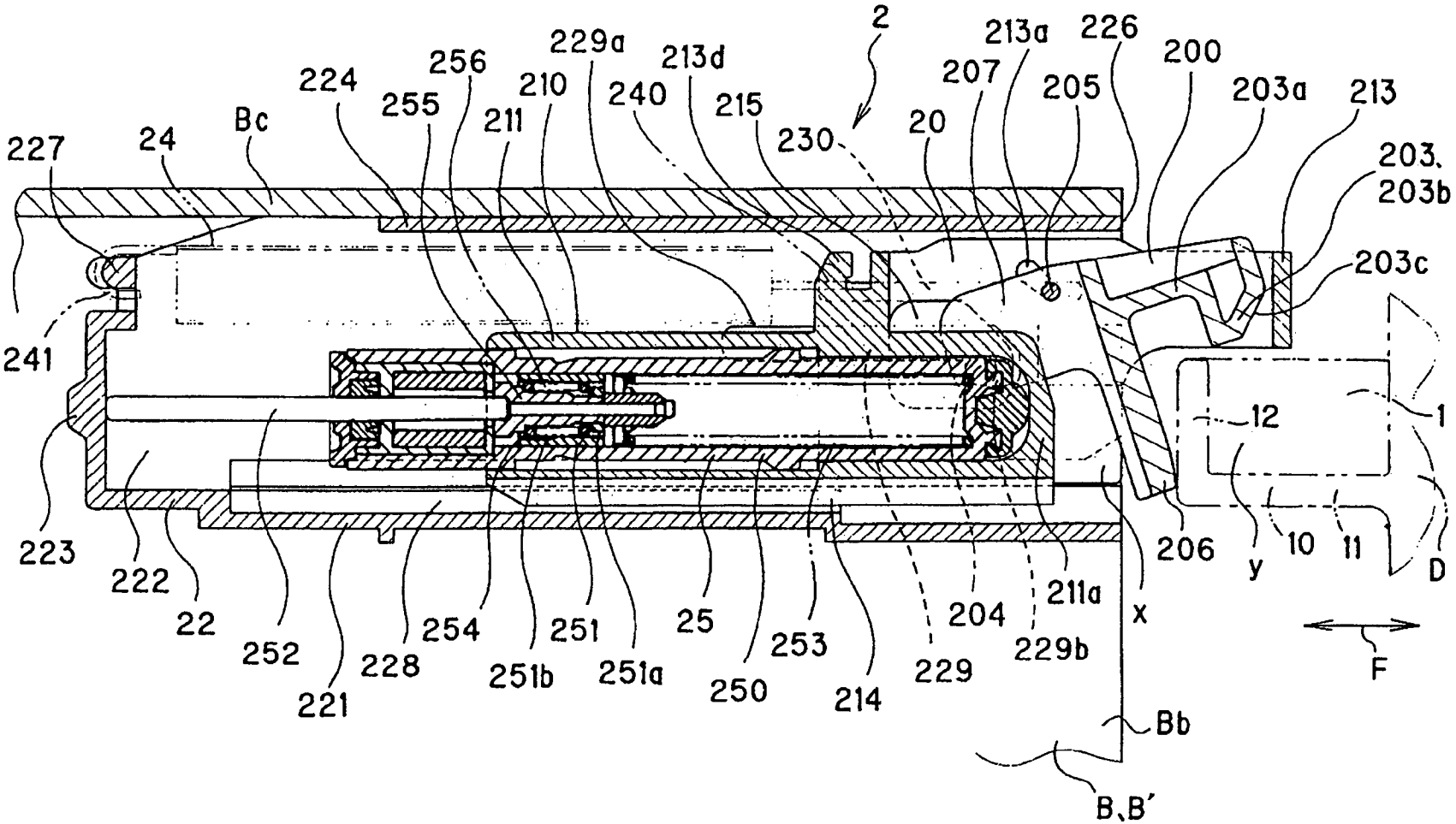
FIG. 6 is a sectional view of the locking mechanism (inner part in an advanced position/rotating part in the tilted position)

In this embodiment, when the inner part 20 is in the advanced position, the front grooves 229*b* of the lock grooves 229 are allowed to catch the locking projections 204 using the bias of the helical tension spring 24, and, at this advanced position, the rotating part 200 is positioned at the tilted position to prevent the hook-shaped section 203 of the rotating part 200 from entering the penetration space y so that the striker 1 can enter when the openable unit D is moved towards the stop position. (FIG. 6)

Figure 7:
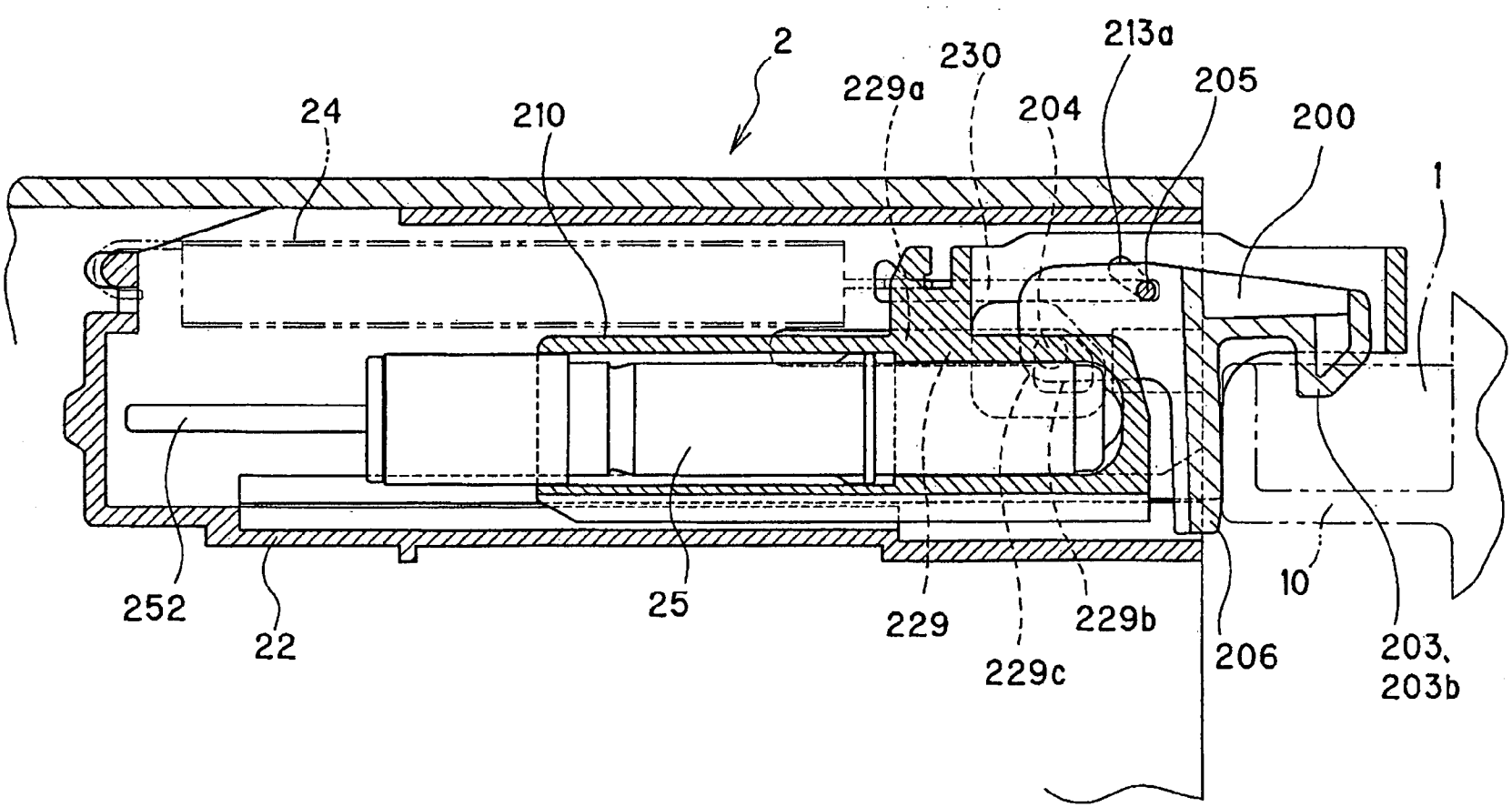
FIG. 7 is a sectional view of the locking mechanism (inner part is slightly advanced past the advanced position/rotating part in the engaging position)
Figure 8:
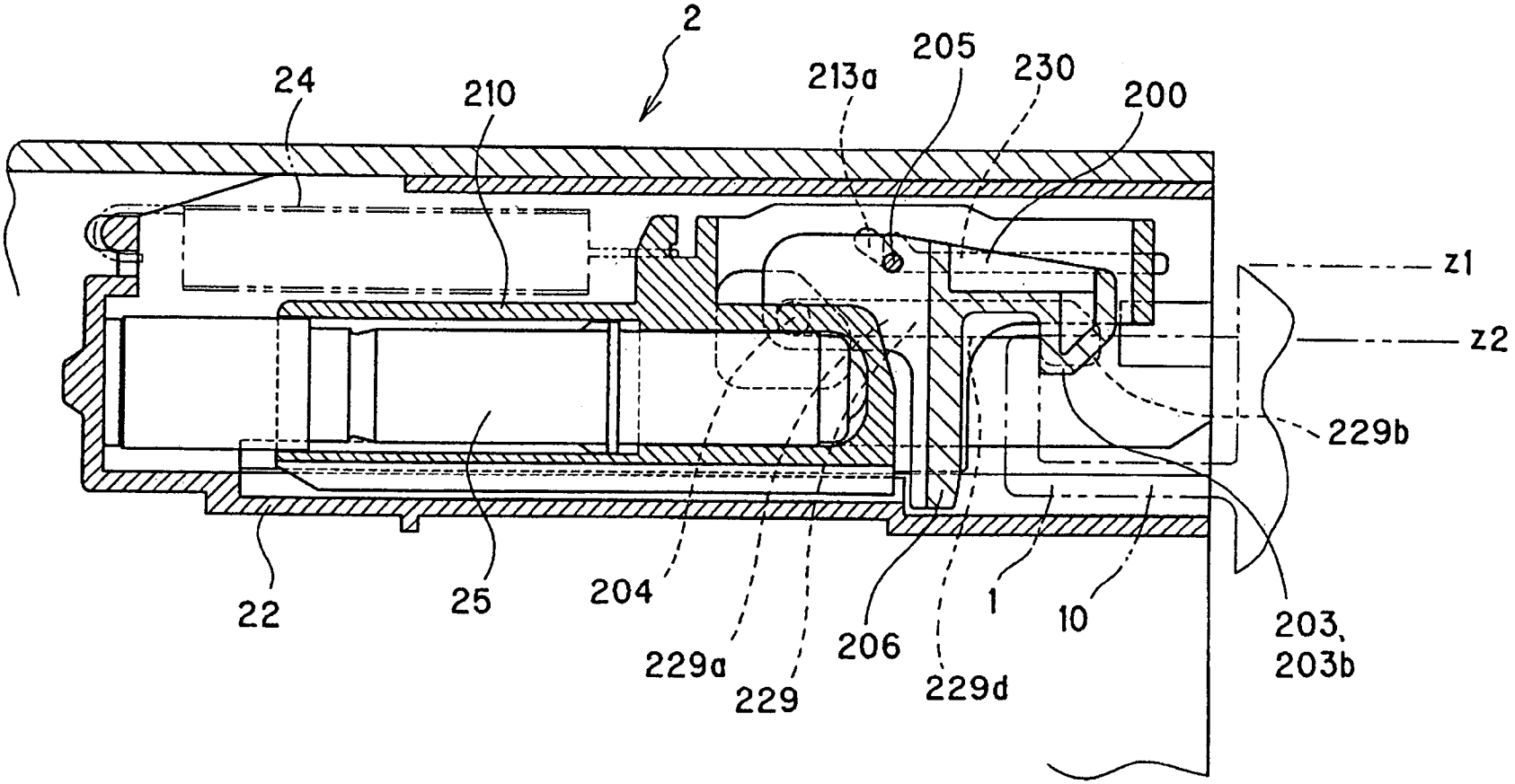
FIG. 8 is a sectional view of the locking mechanism (inner part retreated/rotating part in the engaging position)

At the same time, with the movement of the openable unit D towards the stop position, the head 12 of the striker 1 bumps onto the abutting section 206 of the rotating part 200 that has been in the tilted position. This bumping causes the rotating part 200 to turn about the shaft 205 in the direction to allow the hook-shaped section 203 to enter the penetration space y while slightly advancing the inner part 20 against the bias of the helical tension spring 24, and to allow the locking projections 204 that have been in the front grooves 229*b* of the lock grooves 229 to enter the straight grooves 229*a*. (FIG. 6 to FIG. 7)

In other words, when the inner part 20 is in the advanced position, the rotating part 200 is also biased in the retreating direction via the slider 210 that is biased in the retreating direction by the helical tension spring 24, but the inner part 20 is positioned in the advanced position since the locking projections 204 of the rotating part 200 are fitted in the front grooves 229*b* of the lock grooves 29 of the outer part 22. Since the front grooves 229*b* of the lock grooves 229 are positioned below the through holes 213*a* of the slider 210 for housing the shaft 205 of the rotating part 200 and the guide grooves 230 for housing and guiding the ends 205*a* of the shaft 205, the rotating part 200 is positioned, using the locking projections 204 of the rotating part 200 as fulcrums, in the tilted position to prevent the hook-shaped section 203 from entering the penetration space y. The abutting section 206 of the rotating part 200 is positioned in the penetration space y projecting forwardly at an angle.

(Function)

When the head 12 of the striker 1 abuts against the abutting section 206 of the rotating part 200 in the tilted position with the movement of the openable unit D towards the stop position from the state in which the inner part 20 is in the advanced position, force applies to the rotating part 200 in the direction to move the shaft 205 forward. Since the rotating part 200 and the slider 210 are combined via the shaft 205, the function of this force causes the inner part 20 to slightly advance while expanding the helical tension spring 24. Since this forward movement releases the pressure contact between the locking projections 204 and the lock grooves 229 (more specifically, pressure contact with the catching surfaces 229*c* of the lock grooves 229), the rotating part 200 is turned about the shaft 205 to insert the head 203*b* of its hook-shaped section 203 into the penetration space y and pull the locking projections 204 out of the front grooves 229*b* of the lock grooves 229. (Hereinafter, this state is referred to as the engaging position of the rotating part 200.) With this, the hook-shaped section 10 of the striker 1 engages the hook-shaped section 203 of the rotating part 200 in the penetration space y.

Once the locking projections 204 are pulled out of the front grooves 229*b* of the lock grooves 229, they are guided along the straight grooves 229*a* of the lock grooves 229 using the bias of the helical tension spring 24 to thereby retreat the inner part 20. Since the pitch distance between the locking projections 204 and the shaft 205 remains unchanged, the rotating part 200 is maintained in the engaging position once the locking projections 204 enter the straight grooves 229*a*, and the striker 1 is pulled into the catcher 2, or the outer part 22, without releasing the engagement between the hook-shaped section 203 of the rotating part 200 and the hook-shaped section 10 of the striker 1. (FIG. 7 to FIG. 8) With this, the state in which the abutting section Da' of the openable unit D abuts against the abutted section Ba' of the fixed unit B is forcibly created, and stably maintained. Even in the case in which the traveling speed of the openable unit D directed towards the stop position is relatively low, the aforementioned engagement between the striker 1 and the inner part 20 ensures the full movement of the openable unit D to the stop position where the abutting section Da and the abutted section Ba are abutted with one another.

When this locking mechanism is employed in a hinged door D' that openably covers the opening Bb of a storage unit B', for example, the condition in which the door D' covers the opening Bb with no gap is definitively created by the closing operation of the door D', and this state can be stably maintained.

Such a locking mechanism, moreover, has dampening means 25 to apply dampening force to the retreating movement of the inner part 20 caused by the helical tension spring 24. Thus, even in the case in which the traveling speed of the openable unit D directed towards the stop position is relatively high, this can be dampened, thereby eliminating the generation of impulsive sound that would be generated if the abutting section Da crashes hard against the abutted section Ba.

(Dampening Means 25)

In the example shown in the figures, the dampening means 25 includes (1) a cylinder 250 provided in the slider 210 of the inner part 20, (2) a head 251 having an orifice 251*a* for dividing the space in the cylinder 250 into two sections, and (3) a shaft 252 supported by the outer part 22 for supporting the head 251 inserted into the cylinder 250, and (4) generates dampening force utilizing the flow resistance of the fluid passing through the orifice 251*a* as the inner part 20 retreats.

In the example shown in the figures, more specifically, the aforementioned cylinder 250 is installed in the tubular part 211 of the slider 210 of the inner part 20. The back end of the shaft 252 is pressed against the back plate 223 of the outer part 22. A first compression coil spring 253 is installed between the front end of the shaft 252 and the front end of the cylinder 250; the head 251 is positioned near the back end of the cylinder 250 when not in operation. As the aforementioned fluid, a viscous fluid, typically silicon oil, is put into the cylinder 250. (FIG. 6)

The bias of the helical tension spring 24 moves the inner part 20 from the advanced position with accompanying rearward movement of the cylinder 250 while allowing the fluid pass through the orifice 251*a* created in the head 251. With this, the movement of the inner part 20 is appropriately dampened. In this embodiment, moreover, as the speed at which the inner part 20 is pushed in becomes greater, the fluid channel 254 to the orifice 251*a* becomes narrower.

In the example shown in the figures, more specifically, the head 251 is combined with the shaft 252 so as to move back and forth along the axis of the shaft 252, and a tubular portion 251*b* is formed behind the head 251. The head 251 is always biased towards the front by the second compression coil spring 256 installed between the channel forming part 265, which is installed on the shaft 252 so as to be positioned within the tubular portion 251*b*, and the back surface of the head 251. The fluid passes through the channel 254 created between the outer surface of the channel forming part 255 and the inner surface of the tubular portion 251*b*. The channel forming part 255 is constructed so as to gradually increase its outer diameter towards the back. As the traveling speed of the cylinder 250 constituting the locking mechanism becomes greater, i.e., the retreating speed of the inner part 20 or the closing speed of the openable unit D becomes greater, the channel 254 becomes narrower due to the rearward movement of the head 251 accompanying the movement of the cylinder 250 against the bias of the second compression coil spring 256.

In this embodiment, therefore, the greater the retreating speed of the inner part 20 constituting the locking mechanism becomes, i.e., the greater the closing speed of the openable unit D becomes, the greater the dampening force applied to the retreating movement. Regardless of the traveling speed of the openable unit D towards the stop position, the aforementioned abutting section Da and the abutted section Ba abuts against one another in such a manner that the generation of impulsive sound is prevented. As such dampening means 25, more specifically, the one disclosed in the Japanese Patent Application No. 2003-433572 filed by the present inventor(s) can be used.

(Other Features)

In this embodiment, moreover, moving the openable unit D that is in the stop position towards the initial position, or moving the door D' in the example shown in the figures in the opening direction (return), upon having the hook-shaped section 204 of the rotating part 200 of the inner part 20 in the retreated position catch the hook-shaped section 10 of the striker 1, causes the inner part 20 to move towards the advanced position, and this is accompanied by the force that is applied to the rotating part 200 in the direction to press the locking projections 204 against the groove walls 229*d* of the straight grooves 229*a* of the lock grooves 229 near the front grooves 229*b*.

In the example shown in the figures, when the inner part 20 is in the retreated position, the locking projections 204 of the rotating part 200 are positioned at the back end of the lock grooves 229 (FIG. 8), but the shaft 205 is positioned at a higher level than the locking projections 204, i.e., the locking projections 204 are positioned between the first imaginary line x2, which longitudinally passes through the head 203*b* of the hook-shaped section 203 of the rotating part 200 in the engaged position, and the second imaginary line x1, which passes through the shaft 205. Thus, when the inner part 20 in the retreated position is moved towards the advanced position achieved by the return motion of the openable unit D, the locking projections 204 are slid while being pressed against the groove walls 229*d* of the straight grooves of the lock grooves 229 near the front grooves 229*b*.

Figure 9:
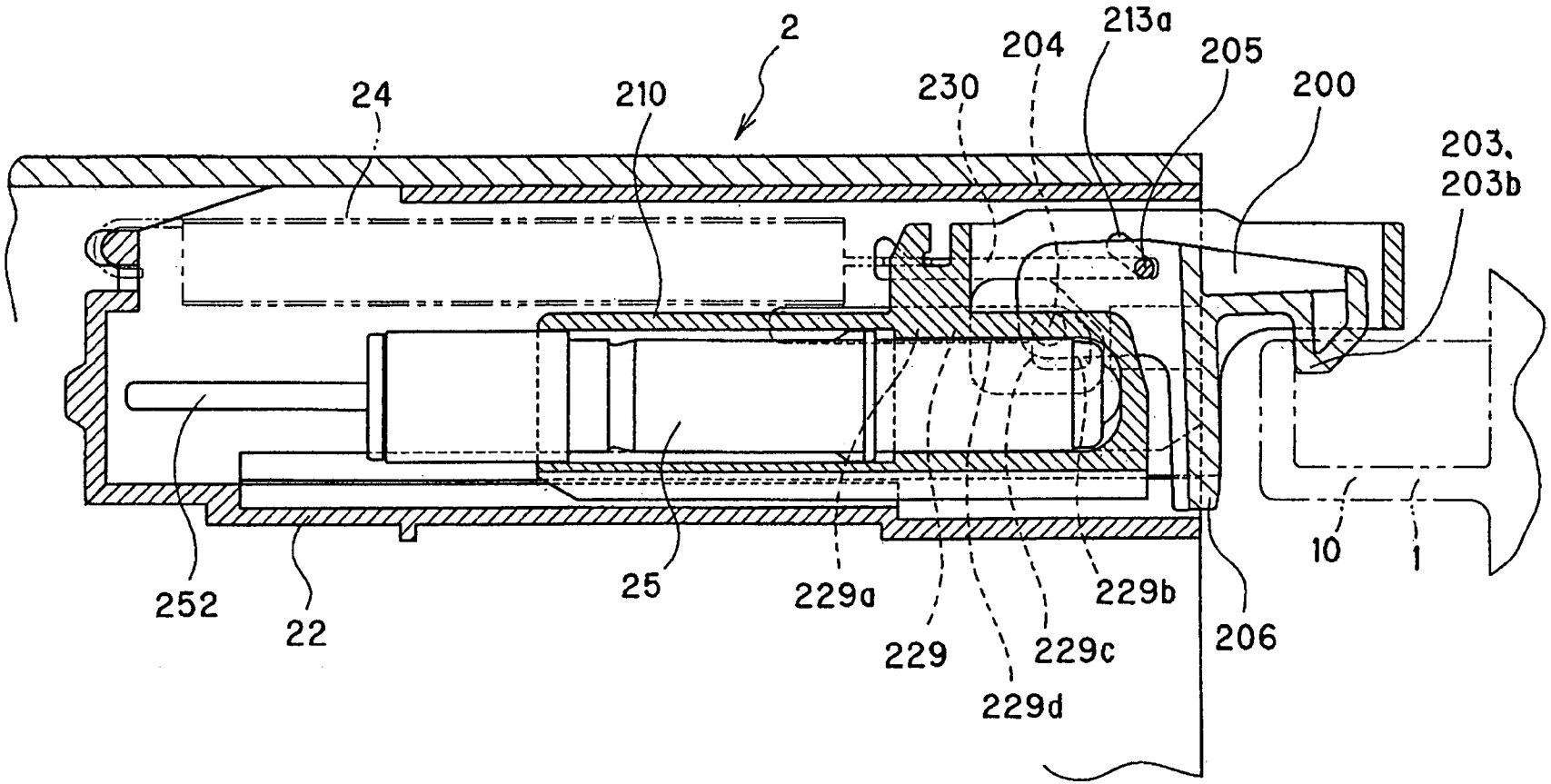
FIG. 9 is a sectional view of the locking mechanism (inner part is slightly advanced past the advanced position/rotating part in the engaging position)
Figure 10:
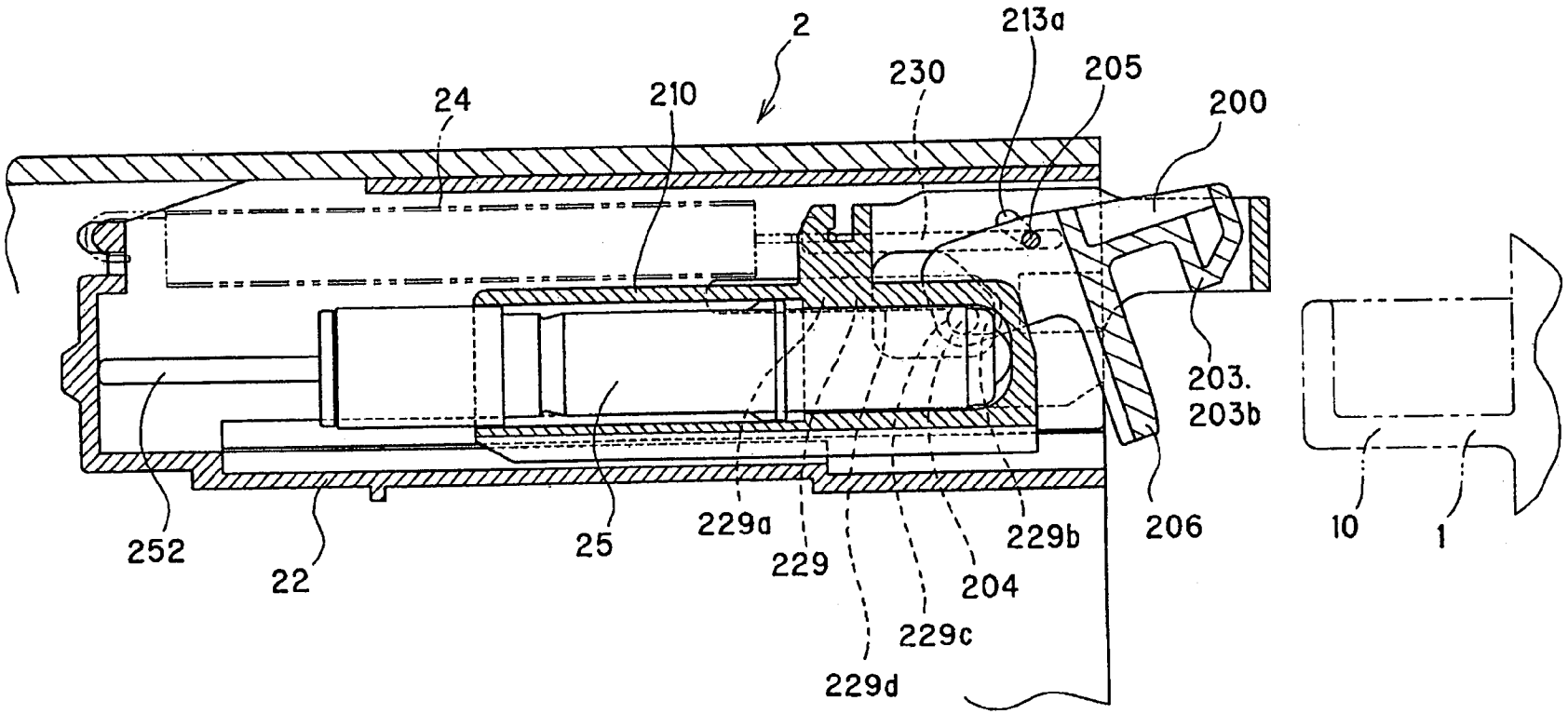
FIG. 10 is a sectional view of the locking mechanism (inner part in the advanced position/rotating part in the tilted position)

In this embodiment, therefore, moving the openable unit D that is in the stop position towards the opening direction causes the locking projections 204 of the rotating part 200 to reenter the front grooves 229*b* when the inner part 20 is pulled to the position where the straight grooves 229*a* and the front grooves 229*b* of the lock grooves 229 of the outer part 22 are connected by the aforementioned force applied to the rotating part 200, thereby allowing the inner part 20 to return to the advanced position, and stably maintaining this state. At the same time that the locking projections 204 reenter the front grooves 229*b*, the rotating part 200 is turned about the shaft 205 to the tilted position again using the bias of the helical tension spring 24, thereby disengaging the hook-shaped section 203 of the rotating part 200 from the hook-shaped section 10 of the striker 1. This disengages the inner part 20 from the striker, and allows the striker 1 to pull out of the catcher 2; the state in which the openable unit D is maintained in the stop position, therefore, can be smoothly terminated with one action. (FIG. 9 to FIG. 10)

In this embodiment, moreover, the through holes 213*a* of the slider 210 are created as slots that are slanted to allow the rotating part 200 to turn about the locking projections 204 to the tilted position while slightly advancing the inner part 20 against the bias of the helical tension spring 24 by utilizing the abutment of the hook-shaped section 10 of the striker 1 against the hook-shaped section 203 of the rotating part 200 within the catcher 2, which is achieved by the movement of the openable unit D towards the stop position in the event that the inner part 20 is moved to the retreated position by an erroneous operation.

In the example shown in the figures, the through holes 213*a* of the slider 210 are slots extending rearwardly along the arc of the imaginary circle, which has a greater curvature than the arc z3 of the imaginary circle having the locking projection 204 as its center and the pitch distance between the locking projection 204 and the shaft 205 as its radius.

Figure 11:
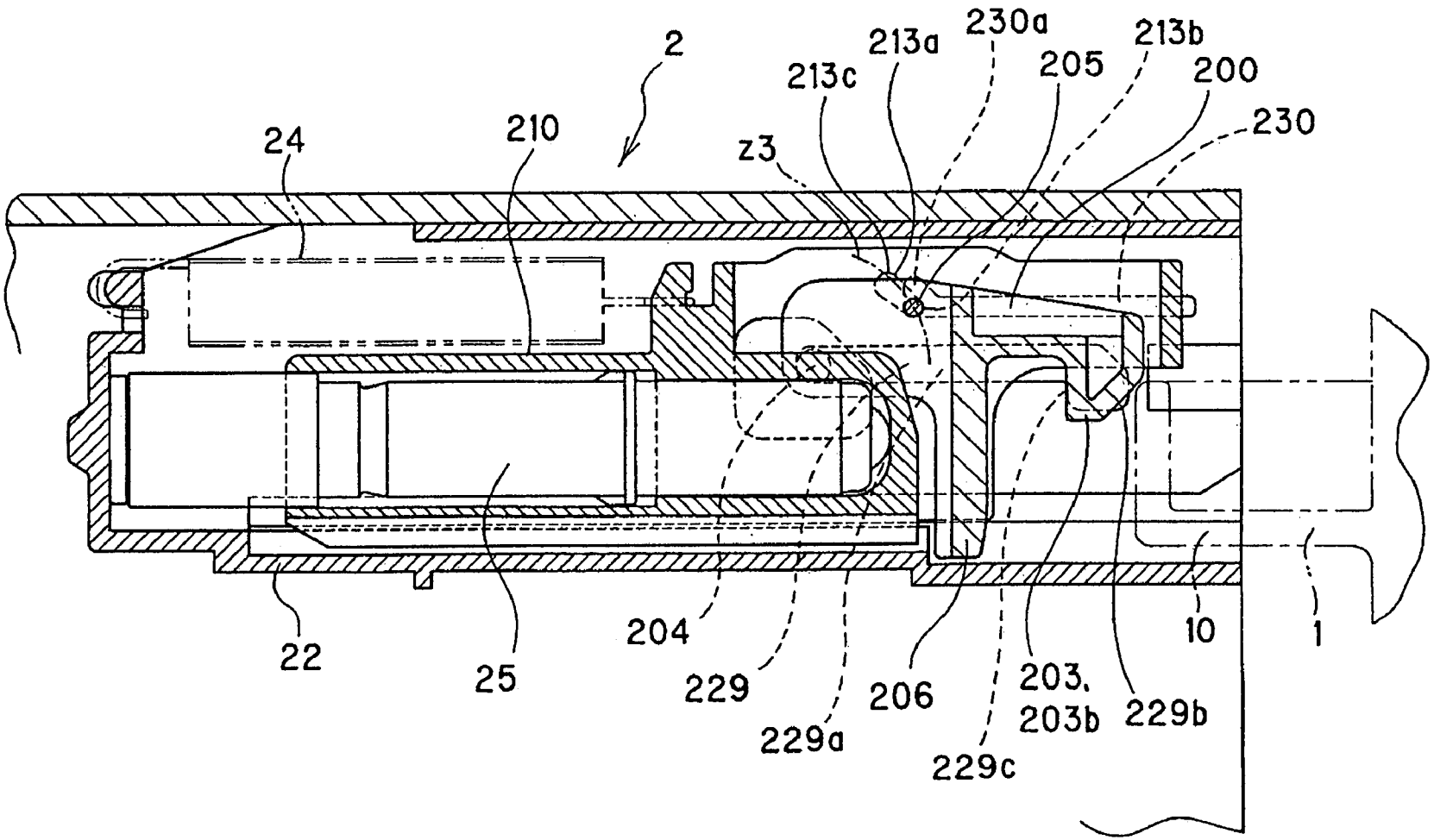
FIG. 11 is a sectional view of the locking mechanism (inner part in the retreated position/rotating part in the engaging position in erroneous operation)

If the inner part 20 is pushed in by mistake without inserting the striker 1 into the aforementioned penetration space y, i.e., in the state in which the openable unit D has not been moved to the stop position, the rotating part 200 would be positioned in the engaged position. The present invention is constructed to allow the striker 1 such that the front face of the head 12 of the hook-shaped section 10 abuts against the front face of the head 203*b* of the hook-shaped section 203 of the rotating part 200 within the outer part 22 by moving the openable unit D towards the stop position from this erroneously operated state. (FIG. 11)

Figure 12:
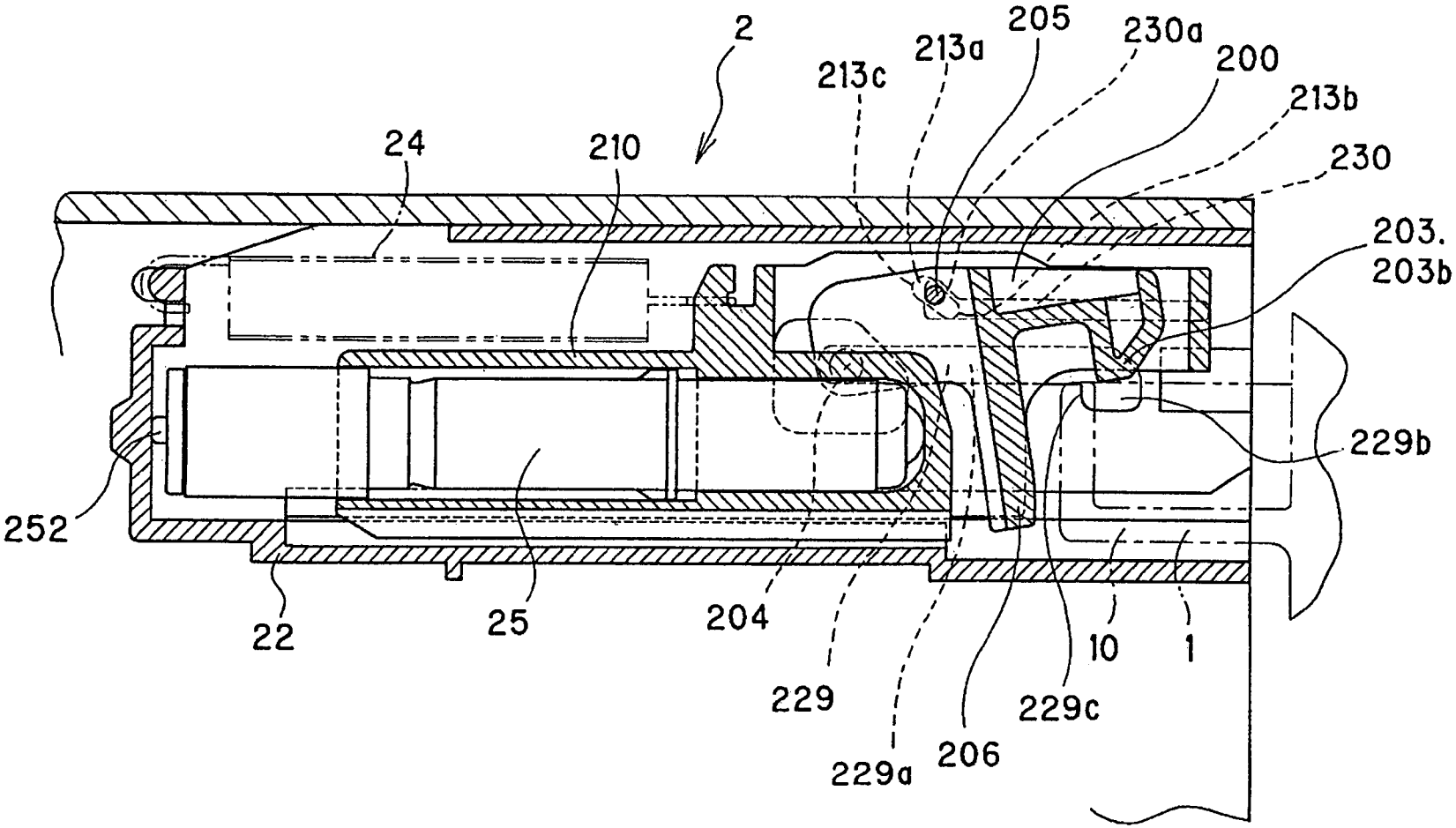
FIG. 12 is a sectional view of the locking mechanism (inner part in the retreated position/rotating part in the tilted position)
Figure 13:
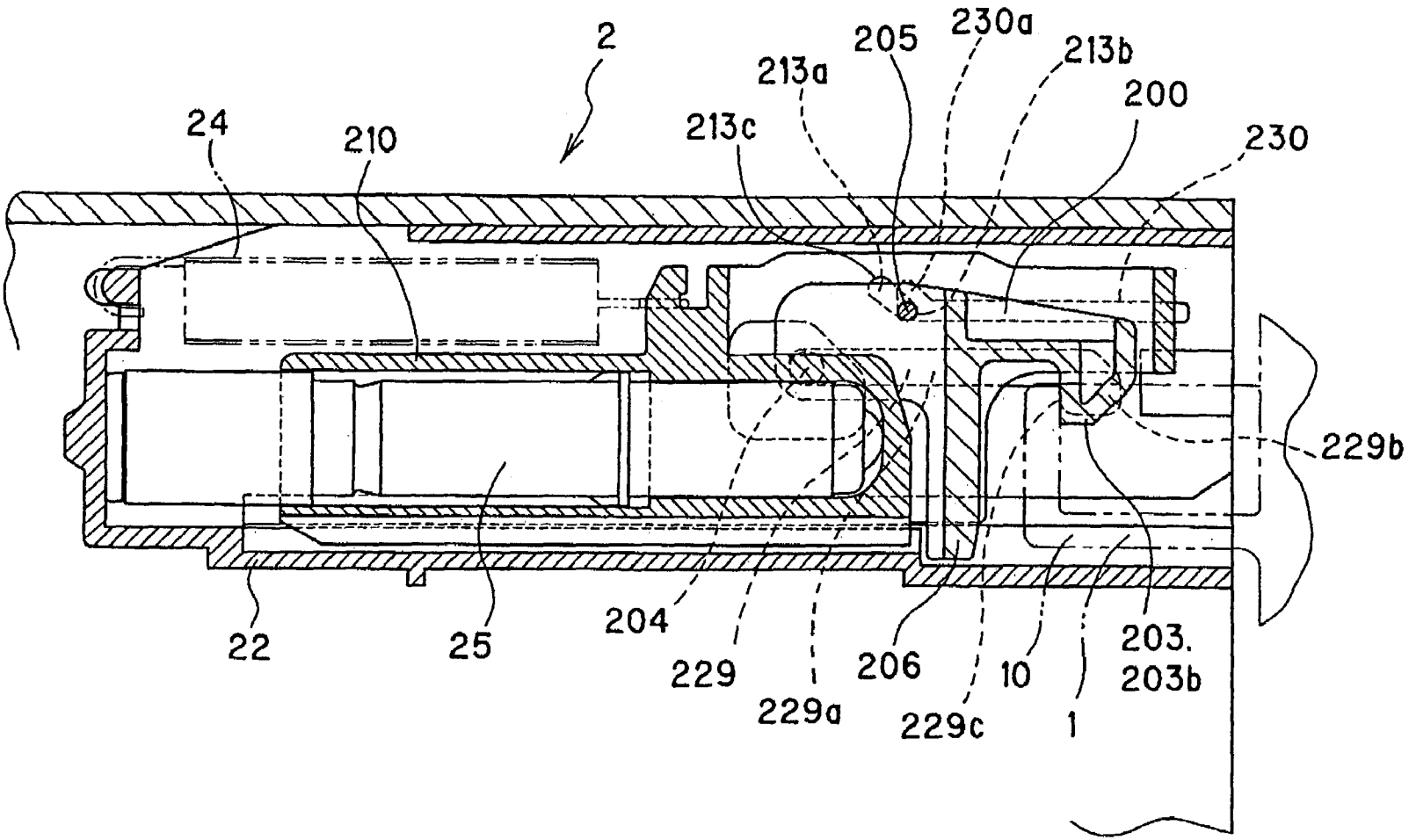
FIG. 13 is a broken-out section of the locking mechanism (inner part in the retreated position/rotating part in the engaging position).

When the openable unit D is moved towards the stop position from the state in which the inner part 20 is erroneously retreated, force is applied to the rotating part 200 by the abutment of the hook-shaped section 10 of the striker 1 against the hook-shaped section 203 of the rotating part 200 occurring in the catcher 2 to turn the rotating part 200 about the locking projections 204 towards the tilted position. Here, since the through holes 213*a* for the shaft 205 are shaped as the aforementioned slots, the force moves the shaft 205 that has been located at the front ends 213*b* of the through holes 213*a* towards the back ends 213*c* of the through holes 213*a*, turns the rotating part 200 to the tilted position; the movement of the shaft 205 slightly advances the inner part 20 while expanding the helical tension spring 24. (FIG. 11) When the head 12 of the hook-shaped section 10 of the striker 1 penetrates in front of the head 203*b* of the hook-shaped section 203 of the rotating part 200, which has been turned to the tilted position, the inner part 20 is moved backward by the resilient recovery of the helical tension spring 24, the shaft 205 is moved back to the front ends 213*b* of the through holes 213*a* of the slider 210, and the rotating part 200 is returned to the engaging position. This produces the same condition as in the case in which the striker 1 is received by the catcher 2 in a normal operation. (FIG. 12 to FIG. 13)

In this embodiment, moreover, a branch groove 230*a*, which is connected at the back end of the guide groove 230 of the outer part 22 and extending upwardly therefrom, is formed to house the end 205*a* of the shaft 205 of the rotating part 200. This tolerates the aforementioned movement of the shaft 205 towards the back ends of the through holes 213*a* of the slider 210, and ensures the regular performance of this movement.

The disclosure of Japanese Patent Application No. 2004-210300 filed on Jul. 16, 2004 is incorporated in the application.

While the invention has been explained with reference to the specific embodiments of the invention, the explanation is illustrative, and the invention is limited only by the appended claims.

What is claimed is:

1. A retracting locking mechanism for an openable unit comprising:

a striker attached to one of the openable unit and a fixed unit, and having a first hook-shaped section, and a catcher attached to the other of the openable unit and the fixed unit, and including an inner part, an outer part for housing the inner part, a coil spring having front and rear ends for always biasing the inner part in a retreating direction to pull into the outer part, and dampening means for providing dampening force to the retreating movement of the inner part caused by the coil spring, wherein said inner part includes a rotating part having a second hook-shaped section at a front end, a locking projection at a back end, a shaft at a middle between the front and back ends, and an abutting section projecting beyond the second hook-shaped section between the second hook-shaped section and the shaft; and a slider having through holes for the shaft of the rotating part so that the slider is assembled with the rotating part via said shaft, said coil spring being connected at the front end to the slider and at the back end to the outer part, and said outer part includes a lock groove having a straight portion along the traveling direction of said inner part and a front portion communicating with the straight portion and extending in the direction perpendicular to the traveling direction, and a guide groove for receiving one end of said shaft formed on one side of the lock groove and extending along the traveling direction of the inner part.

2. A retracting locking mechanism according to claim 1, wherein said through holes are arranged in the slider such that when the inner part is in an advanced position, said locking projection engages the front groove of the lock groove by a bias of the coil spring while positioning the rotating part in a tilted position to prevent the second hook-shaped section of the rotating part from entering a space into which the striker enters as the openable unit is moved towards a stop position; and upon moving the openable unit towards the stop position, a head of the striker abuts against the abutting section of the rotating part in the tilted position so that the rotating part rotates about the shaft in a direction to allow the second hook-shaped section to enter the space while slightly advancing the inner part against the bias of the coil spring and allow the locking projection, which has been located in the front portion of the lock groove, to enter the straight portion.

3. A retracting locking mechanism according to claim 2, wherein said first hook-shaped section includes a first neck extending along the traveling direction of the openable unit and a first head projecting from the first neck in a direction perpendicular to the traveling direction, and said second hook-shaped section includes a second neck and a second head at a front end section.

4. A retracting locking mechanism according to claim 1, wherein said inner part is arranged so that a force in a direction to press the locking projection of the rotating part against a groove wall of the straight portion of the lock groove is applied on a front groove side when the inner part is moved towards an advanced position by moving the openable unit in a stop position towards an initial position when the second hook-shaped section of the rotating part in the retreated position catches the first hook-shaped section of the striker.

5. A retracting locking mechanism according to claim 2, wherein said through holes of the slider are slot-shaped and tilted to allow the rotating part to rotate about the locking projections while slightly advancing the inner part against the bias of the coil spring by utilizing abutment of the first hook-shaped section of the striker against the second hook-shaped section of the rotating part within the catcher by moving the openable unit towards the stop position in a event that the inner part is moved to the retreated position by an erroneous operation.

6. A retracting locking mechanism according to claim 2, wherein said dampening means comprises a cylinder disposed in one of the inner part and the outer part, a head having an orifice for dividing the space within the cylinder in two sections, and a shaft supported by the other of the inner part and the outer part for supporting the head inserted into the cylinder, said dampening means generating dampening force by utilizing flow resistance of the fluid passing through the orifice with the retreating movement of the inner part.

7. A retracting locking mechanism according to claim 6, wherein said orifice has a fluid channel formed so as to become narrower as a speed at which the inner part is pressed in increases.

8. A retracting locking mechanism according to claim 2, wherein said guide groove and lock groove are disposed on two sides of the outer part.

* * * * *